United States Patent [19]

Goldbeck

[11] 4,381,719

[45] May 3, 1983

[54] SEWING MACHINE WITH A STITCH COUNTER AND CORRECTION UNIT

[75] Inventor: Heinz Goldbeck, Bielefeld, Fed. Rep. of Germany

[73] Assignee: Dürkoppwerke GmbH, Bielefeld, Fed. Rep. of Germany

[21] Appl. No.: 263,172

[22] Filed: May 13, 1981

[30] Foreign Application Priority Data

May 16, 1980 [DE] Fed. Rep. of Germany ..... 3018797

[51] Int. Cl.[3] ..... D05B 19/00; D05B 69/20; D05B 69/22

[52] U.S. Cl. ..... 112/121.11; 112/272; 112/275

[58] Field of Search ..... 112/121.11, 272, 275, 112/277, 121.12

[56] References Cited

U.S. PATENT DOCUMENTS 4,160,424 7/1979 Newell et al. ..... 112/275
4,226,197 10/1980 Pollmeier ..... 112/121.11
4,254,724 3/1981 Conrads ..... 112/121.11 X

*Primary Examiner*—Peter P. Nerbun
*Attorney, Agent, or Firm*—Karl F. Ross; Herbert Dubno

[57] ABSTRACT

A sewing machine with a presettable counter for sewing a predetermined number of stitches to the end of a stitch seam. According to the invention the counter is provided with a correction unit responsive to at least two sectors of a rotary machine member, each revolution of which corresponds to the sewing of a stitch of normal length. A sensor is responsive to the different sectors and, upon detection of one of these sectors, produces a signal which an evaluating unit can pass to a count resetting unit to set back the stitch counter by one stitch unit. As a consequence, the overrun or underrun of the stitch seam is at most one half of the normal length of a stitch.

5 Claims, 5 Drawing Figures

SEWING MACHINE WITH A STITCH COUNTER AND CORRECTION UNIT

FIELD OF THE INVENTION

My present invention relates to a sewing machine and, more particularly, to a high-speed sewing machine having a presettable stitch counter for terminating a stitch seam in response to a count registered in the counter.

BACKGROUND OF THE INVENTION

For high quality sewing of stitch seams utilizing high-speed sewing machines, especially for the formation of stitch seams on visible portions of high quality garments, it is important that the stitch terminate at particular locations and neither overrun nor underrun the desired end point of the stitch seam significantly.

This is necessary so that the stitch seam appears, as much as possible, to be similar to a handstitched seam.

For example, when pocket flaps are sewn on an outer garment, e.g. jackets, trousers, dresses or the like, the flap is generally stitched to the garment at its upper edge by a stitch seam whose length is precisely determined by the length of the flap.

The exact point which the stitch seam should commence is readily determined since the flap is generally brought into contact with the sewing machine needle in a lowered position thereof or into contact with an abutment to precisely position the flap vis-a-vis the sewing location.

At the opposite end of the seam, however, such positioning is not possible.

With manual operation of a sewing machine, the operator, as he approaches the end of the stitch seam, visually determines the point at which the seam should end and generally slows down the rate of feed of the fabric and the speed of the machine so that the final stitch should be as close as possible to the visually determined end point.

It is possible in this manner, to shorten the last stitch or stitches to bring about a reasonably precise end to the stitch seam.

However, with automatic sewing machines and especially high-speed sewing machines in production plants for garments, a manual reduction in speed of the machine and indeed even operator control of the termination of the stitch seam is generally not possible without significantly reducing the production rate and rendering the automation of the plant a nullity.

Automatic sewing machine installations, therefore, must rely upon other means for determining the end of the flap and for terminating the formation of the stitch seam by cutting off the sewing machine at the desired point.

For this purpose, it is known to provide upstream of the stitching location in the direction of feed of the fabric work pieces, a reflective light curtain which responds to the passage of the end of the flap and operates a presettable stitch counter which counts down the number of stitches corresponding to the distance between the curtain and the stitching location, thereby terminating the operation of the sewing machine when the preset count is achieved.

In the case of the flap of a pocket or the like, the trailing edge of the flap is detected by the light curtain and only the number of preset stitches on the presettable stitch counter can be then generated by the machine.

While this system is effective to terminate the stitch seam approximately in the region of the trailing edge of the flap, it nevertheless is unsatisfactory when the stitch seam is to appear more or less as a manually sewn seam.

The reason for this is inherent in the machine structure and system.

For example, the arm of the sewing machine is provided with an arm shaft which drives the needle in its up-and-down motion, each revolution of the shaft corresponding to the formation of a complete stitch of the customary stitch length (hereinafter referred to as the single stitch length).

Since the arm shaft can assume an infinite number of angular positions at the point at which the light curtain signals the beginning of the countdown of the presettable stitch counter, and the counter will result in a complete preset number of stitches generated after it is triggered by the light curtain, the last stitch point seldom coincides with the ideal end point of the seam, but rather can overrun or underrun this set point by almost an entire stitch length.

In other words, the final position of the needle can be approximately a full stitch length ahead of or behind the ideal end point.

This is invariably the case because the feed of the fabric is also coupled to the arm shaft rotation.

Thus, in the case of long stitches, i.e. single-stitch lengths which are considerable, the overrun or underrun may be highly visible and will generally detract from the quality of the garment.

OBJECTS OF THE INVENTION

It is the principal object of the present invention to provide a sewing machine system which will allow termination of a stitch seam closer to the ideal termination than has hitherto been the case.

Another object of the invention is to provide an improved countdown-type sewing machine system whereby the disadvantages of the earlier arrangements are obviated.

SUMMARY OF THE INVENTION

These objects and others which will become apparent hereinafter are attained, in accordance with the invention, in a sewing machine with automatically effective control means including a presettable stitch counter for sewing a predetermined number of stitches to reach the end of a stitch seam. According to the invention, the presettable stitch counter is provided with a correction unit for correcting the originally preset count to the end of the stitch seam. This correction unit comprises a sensor which can respond to at least two different sensing sectors of a movable portion of a sewing machine, preferably a portion which moves in a cyclical manner so that each cycle brings these sectors successively into the response region of the detector and corresponds to a single stitch sewn by the machine.

The sensor is provided with an evaluator circuit which responds to the signal obtained by the sector and, upon detection of one of the sectors, operates a count resetting circuit to set back the stitch counter by one stitch unit when one of the two sectors is detected.

By the setting back of the stitch counter upon detection of one of the two sectors of the operating cycle of a moving element coupled with the stitch-forming mechanism, it is possible to reduce the overrun or underrun by an appropriate fraction of the cycle, say half.

Preferably, the sensor responds to two sectors carried by the arm shaft of the sewing machine and of different reflectivities, when the sensor is a reflected-light sensor. The two sectors may each extend through about 180° of the revolution of the arm shaft.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
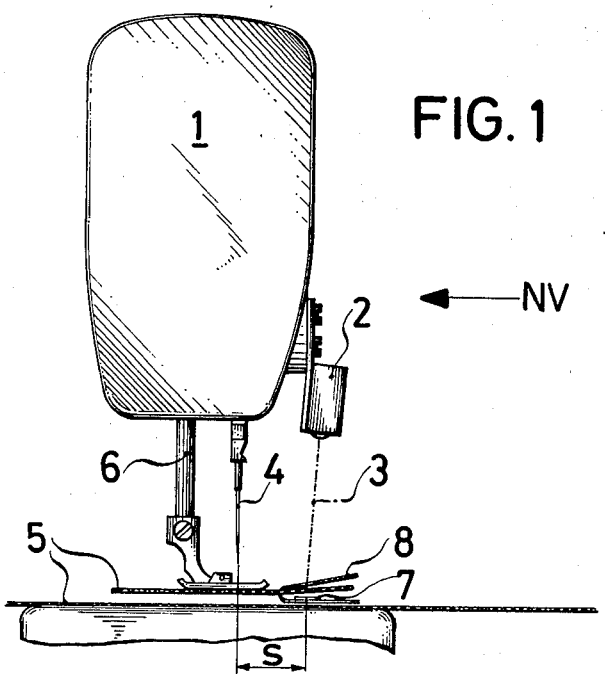
FIG. 1 is a front-elevational view of the arm head and sewing station of a sewing machine in accordance with the invention, provided with a reflected-light curtain for detecting the terminal part of the workpiece, e.g. flap, to be sewn onto an underlying workpiece, e.g. a garment, by the sewing machine with a controlled stitch seam in accordance with the invention.
Figure 2:
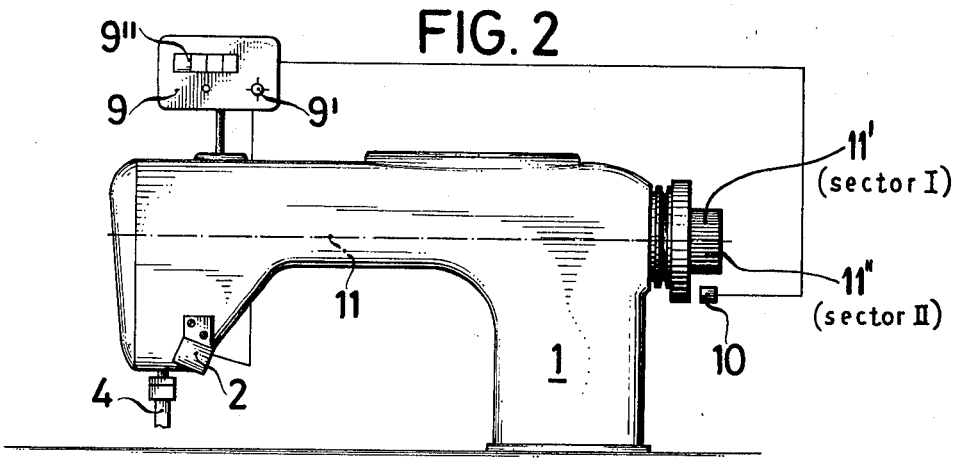
FIG 2. is a side-elevational view of the sewing machine diagrammatically indicating its arm shaft and the sensing mechanism for the sectors.

The sewing machine 1 shown in FIGS. 1 and 2 is a conventional high-speed industrial sewing machine which is provided with a reflected-light curtain or detector represented at 2. In accordance with the principles of such detectors, a phototransistor and a light source are contained in a common housing mounted on the side of the arm and direct a light bundle or seam (light curtain) as shown at 3 onto a reflecting surface 7 fixed to the table.

The pocket flap of the compound workpiece 5 can be passed over this foil, which can be carried on a plate on which the flap is guided to the stitching site, while the substrate or garment of the workpiece 5 passes below the foil.

While the pocket flap covers the foil, light is not reflected from the lamp of unit 2 back to the phototransistor and no signal is outputted by the light curtain.

However, as the trailing edge of the pocket passes over the curtain, the light beam is reflected and a signal delivered to a presettable stitch counter 9.

This counter, which can have a setting knob 9′ to preset the number of stitches to be counted down, displaced on a scale or indicator 9″, is conventional in the art. The preset number of stitches is $n \times L = s$, where n is the preset number of stitches, L is the single-stitch length, and s is the distance between the stitching location and the light curtain or reflection location.

At the stitching location, the usual needle assembly represented at 4 is provided, the needle assembly cooperating with the presser foot 6 and with a fabric-feed mechanism (not shown) to form the stitches.

The fabric-feed direction is represented at NV.

The above-described portions of the sewing machine and its control system are of conventional construction and function in the usual way.

Figure 3:
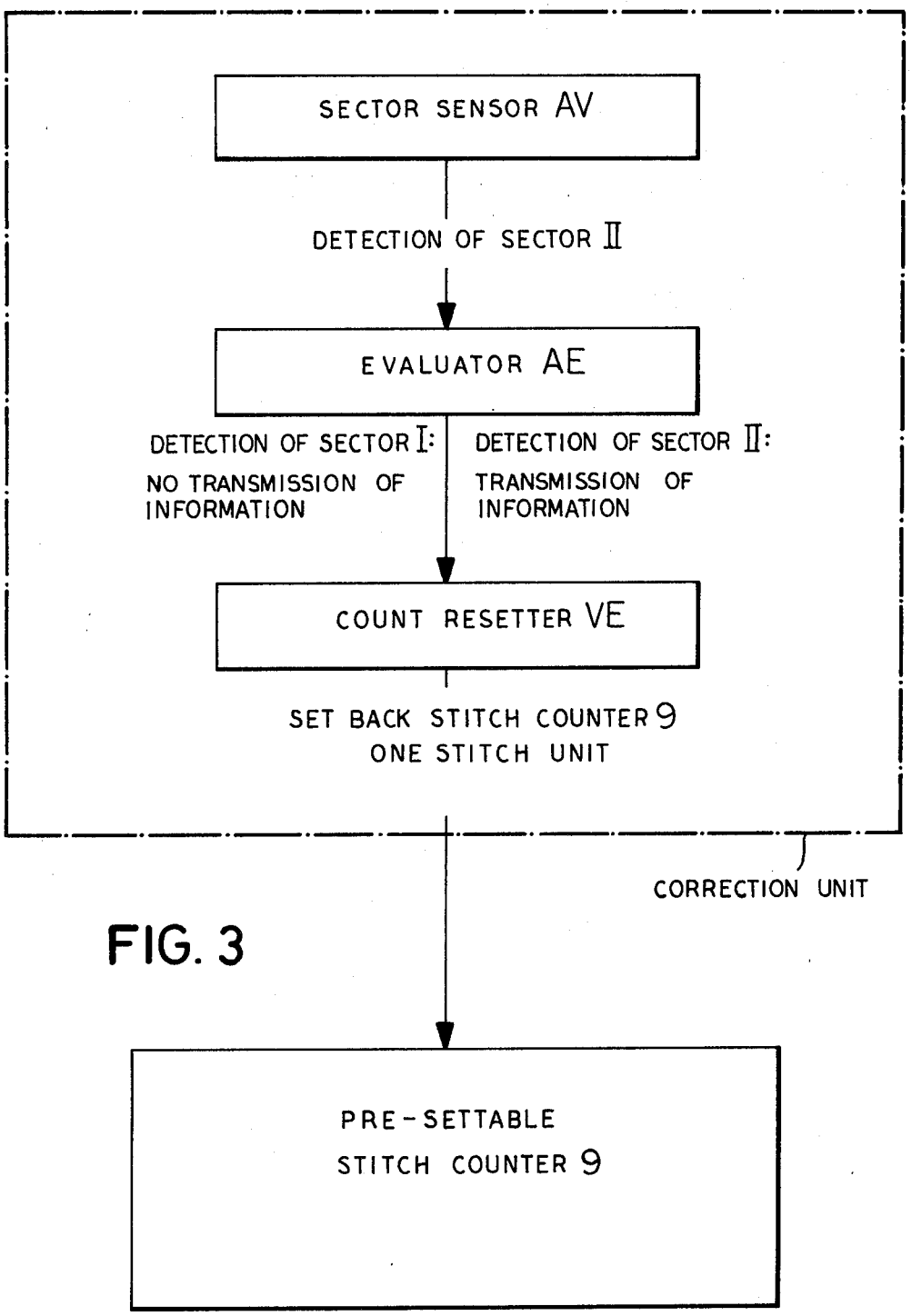
FIG. 3 is a block-diagram of information flow in accordance with the principles of the invention.

According to the invention, the machine is provided with a corrector unit, represented diagrammatically in FIG. 3. This correction unit is connected to the stitch counter and operates in the manner described.

The correction unit, as FIG. 3 diagrammatically shows, comprises a sensor AV, an evaluator AE in the form of a signal-processing circuit (e.g. a Schmitt trigger in combination with an AND gate), and a count-resetting circuit VE (e.g. a flip-flop) which can step or set back the counter 9 which can be an up-down counter, also conventional in control circuit design.

The sensor AV is, in the embodiment shown, a reflective-light curtain arrangement similar to that described for the sensor 2. In this case, the sensor 10 includes a light source and a phototransistor, the light source directing the light beam against a drum having two sectors I and II which have been shown diagrammatically at 11′, 11″ in FIG. 2. Each of these sectors extends through approximately 180°. For example, sector I can run from 0° to 180°, while sector II can run from 180° to 360°.

Sector I is a bright reflective surface while sector II is a dark, rough and nonreflective surface.

At the instant the light curtain 2 detects the passage of the trailing edge of the pocket flap, the logic circuitry of the evaluator AE is enabled to respond to the sector I or II juxtaposed with the detector 10.

If sector I is juxtaposed with the detector 10, no further information is transmitted until sector II is juxtaposed therewith.

If sector II is detected at the instant of passage of the trailing edge of the flap, the signal is immediately transmitted by the logic circuitry AE to the count-resetting circuit VE to set back the presettable stitch counter 9 by one unit, i.e. a single stitch.

Thus, if the preselected stitch count was ten stitches, as set by the knob 9′ and displayed by the scale 9″ (the setting being done originally by hand) the stitch count 9 will be reset to nine stitches and after the passage of nine stitches will stop the machine.

Thus, when one sector is detected at the critical instant by the detector 10, the full stitch count applies while, when the other sector is detected at the critical moment, a stitch count one less applies.

Figure 4:
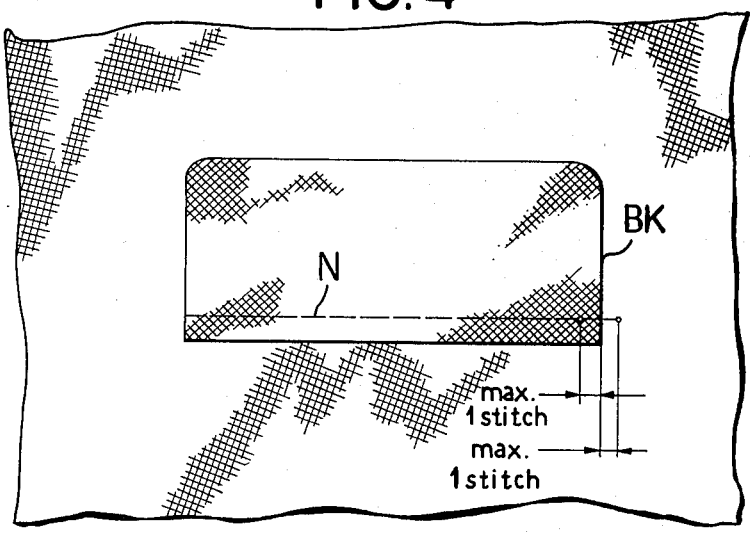
FIG. 4 is a plan view diagrammatically illustrating the tolerance range of a prior art control system.
Figure 5:
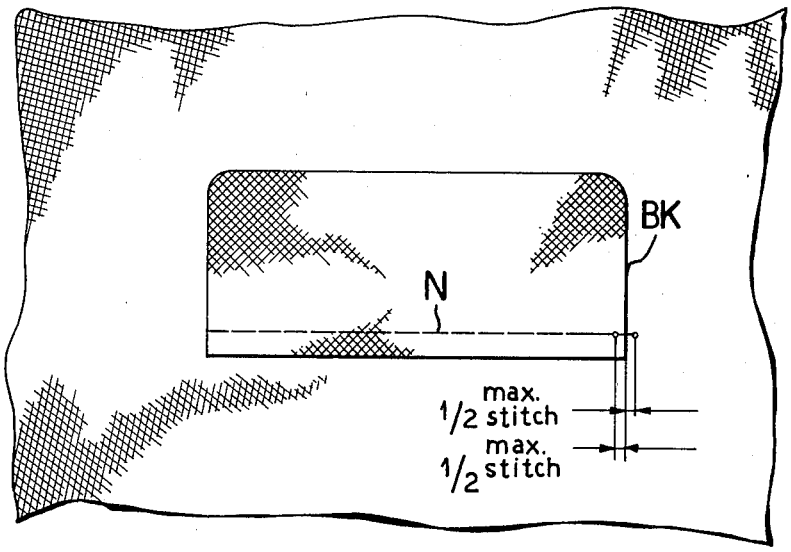
FIG. 5 is a diagram similar to FIG. 4 showing the tolerance range with the system of the present invention.

The result of this mode of operation can be seen by a comparison of FIGS. 4 and 5.

From FIG. 4, it will be seen that the stitch seam N can deviate in length by a maximum of one stitch to either side of the end BK of the flap, i.e. the reference edge.

However, since the system of the present invention allows either the full count or a count reduced by one to apply so that the maximum deviation to either side of the reference edge BK is one-half stitch as shown in FIG. 5.

Even with long stitches, therefore, overruns and underruns can be held to scarcely visible tolerable limits.

I claim:

1. In a sewing machine having a sewing machine arm and mechanism including a cyclically operating moving member for producing a succession of stitches forming a stitch seam, means for detecting the trailing edge of a workpiece part to be sewn with said seam, and a presettable stitch counter responsive to said detecting means for terminating operation of the sewing machine after the sewing of a number of stitches corresponding to that set in said counter, the improvement which comprises a correcting unit for controlling the count registered in said counter, said unit comprising sensing means responsive to at least two different sensing sectors of said member, evaluating means connected to said sensing means and generating an output when said sensing means responds to one of said sectors, and adjusting means connected to said evaluating means and responsive thereto to reset the count in said counter in accordance with the output of said evaluating means.

2. The improvement defined in claim 1 wherein said member is an arm shaft of said sewing machine and said arm shaft carries two sectors each extending over substantially 180°, said adjusting means resetting the count in said counter by a full stitch in response to said evaluating means.

3. The improvement defined in claim 2 wherein one of said sectors is highly reflective and the other of said sectors has low reflectivity, said sensing means including means for directing a light beam against said sectors and means responsive to reflected light from said sectors for generating a signal which is applied to said evaluating means.

4. The improvement defined in claim 3 wherein said detecting means includes a light curtain forming a light beam which is interrupted by said workpiece part.

5. The improvement defined in claim 1, claim 2, claim 3 or claim 4 wherein said presettable counter comprises a knob for setting the stitch count and a display for displaying the preselected stitch count.

* * * * *